US010927630B2

(12) United States Patent
Van der Veen et al.

(10) Patent No.: US 10,927,630 B2
(45) Date of Patent: Feb. 23, 2021

(54) CASING EXIT JOINT WITH GUIDING PROFILES AND METHODS FOR USE

(71) Applicant: Halliburton Energy Services, Inc., Houston, TX (US)

(72) Inventors: Steffen Helgesen Van der Veen, Stavanger (NO); Espen Dahl, Stavanger (NO); Morten Falnes, Sola (NO); Stuart Alexander Telfer, Stonehaven (GB); Neil Hepburn, Newcastle-Upon-Tyne (GB)

(73) Assignee: Halliburton Energy Services, Inc., Houston, TX (US)

( * ) Notice: Subject to any disclaimer, the term of this patent is extended or adjusted under 35 U.S.C. 154(b) by 71 days.

(21) Appl. No.: 15/747,349

(22) PCT Filed: Sep. 16, 2016

(86) PCT No.: PCT/US2016/052239
§ 371 (c)(1),
(2) Date: Jan. 24, 2018

(87) PCT Pub. No.: WO2018/052442
PCT Pub. Date: Mar. 22, 2018

(65) Prior Publication Data

US 2018/0363401 A1 Dec. 20, 2018

(51) Int. Cl.
*E21B 29/06* (2006.01)
*E21B 7/06* (2006.01)
(Continued)

(52) U.S. Cl.
CPC ..... *E21B 29/06* (2013.01); *E21B 7/061* (2013.01); *E21B 17/08* (2013.01); *E21B 41/0035* (2013.01)

(58) Field of Classification Search
CPC ..... E21B 17/08; E21B 29/06; E21B 41/0035; E21B 41/0042; E21B 7/061
See application file for complete search history.

(56) References Cited

U.S. PATENT DOCUMENTS 5,275,240 A * 1/1994 Peterson ..... F16L 9/02 138/173
5,353,876 A 10/1994 Curington et al.
(Continued)

FOREIGN PATENT DOCUMENTS

RU 2365729 C1 8/2009
RU 2441132 C2 1/2012
(Continued)

OTHER PUBLICATIONS

International Search Report and Written Opinion issued in related PCT Application No. PCT/US2016/052239 dated May 26, 2017, 13 pages.
(Continued)

*Primary Examiner* — Christopher J Sebesta
(74) *Attorney, Agent, or Firm* — Scott Richardson; Baker Botts L.L.P.

(57) ABSTRACT

A casing exit joint with guiding profiles and methods for use are provided. In one embodiment, a casing exit joint comprises: a substantially tubular casing joint comprising an inner surface and an outer surface, wherein at least a circumferential portion of the inner surface comprises a plurality of axial inner grooves. In certain embodiments, at least a circumferential portion of the outer surface may comprise a plurality of axial outer grooves. The casing exit joint may be disposed in a wellbore penetrating at least a portion of a subterranean formation, and a cutting tool may cut a window through at least a portion of the casing exit joint. In certain embodiments, the axial inner grooves and/or outer grooves may reduce the amount of milling debris,
(Continued)

prevent lateral displacement of the cutting tool, and/or eliminate the need to pre-orient the casing exit joint to achieve the desired exit window.

19 Claims, 6 Drawing Sheets

(51) Int. Cl.
*E21B 17/08* (2006.01)
*E21B 41/00* (2006.01)

(56) References Cited

U.S. PATENT DOCUMENTS 6,041,855 A * 3/2000 Nistor ..... E21B 17/00 166/242.1
6,070,665 A * 6/2000 Singleton ..... E21B 7/061 166/242.1
6,079,494 A 6/2000 Longbottom et al.
6,679,329 B2 1/2004 Murray et al.
6,732,802 B2 5/2004 Smith
6,749,026 B2 6/2004 Smith et al.
6,789,628 B2 9/2004 Hess et al.
6,830,106 B2 12/2004 Cavender
6,935,428 B2 8/2005 McGlothen et al.
7,584,795 B2 9/2009 Hepburn et al.
8,505,621 B2 8/2013 Telfer et al.
9,175,560 B2 11/2015 Algeroy et al.
2003/0159826 A1* 8/2003 Ohmer ..... E21B 19/12 166/298
2004/0168807 A1* 9/2004 McGlothen ..... E21B 41/0042 166/313
2005/0161215 A1 7/2005 Hall et al.
2009/0288817 A1* 11/2009 Parlin ..... E21B 7/06 166/50
2009/0288829 A1* 11/2009 Parlin ..... E21B 7/06 166/285
2011/0240272 A1 10/2011 Telfer et al.
2011/0240282 A1* 10/2011 Telfer ..... E21B 29/06 166/117.5
2014/0216760 A1* 8/2014 Dancer ..... E21B 7/061 166/382

FOREIGN PATENT DOCUMENTS

RU 2578062 C1 3/2016
WO 1998/013578 A1 4/1998

OTHER PUBLICATIONS

Office Action and Search Report issued in Russian Patent Application No. 2019104309/03 dated Sep. 16, 2019, 13 pages.

* cited by examiner

CASING EXIT JOINT WITH GUIDING PROFILES AND METHODS FOR USE

CROSS-REFERENCE TO RELATED APPLICATION

The present application is a U.S. National Stage Application of International Application No. PCT/US2016/052239 filed Sep. 16, 2016, which is incorporated herein by reference in its entirety for all purposes.

BACKGROUND

Hydrocarbons can be produced through a wellbore traversing a subterranean formation. The wellbore may be relatively complex. For example, the wellbore can include branch wellbores, such as multilateral wellbores and/or sidetrack wellbores. Multilateral wellbores include one or more lateral wellbores extending from a parent (or main) wellbore. A sidetrack wellbore is a wellbore that is diverted from a first general direction to a second general direction. A multilateral wellbore can include a window to allow lateral wellbores to be formed. A sidetrack wellbore can include a window to allow the wellbore to be diverted to the second general direction.

A window can be formed by positioning a casing exit joint and a whipstock in a casing string at a desired location in the main wellbore. The whipstock can deflect one or more mills through the casing wall in one or more orientations. The deflected mills penetrate part of the casing exit joint to form the window in the casing exit joint through which drill bits can drill the lateral wellbore or the secondary wellbore.

Casing exit joints are often made from high-strength material. The high-strength material may also be non-corrosive to withstand corrosive elements, such as hydrogen sulfide and carbon dioxide, which may be present in the subterranean environment. Milling a portion of the high-strength material can be difficult and can create a large amount of debris, such as small pieces of the casing exit joint, that can affect detrimentally well completion and hydrocarbon production. The debris can prevent the whipstock from being retrieved easily after milling is completed, plug flow control devices, damage seals, obstruct seal bores, and interfere with positioning components in the main bore below the casing exit joint. When debris is circulated out of the well, it can foul surface equipment.

Lateral displacement of the cutting tool is commonly associated with casing exit milling. Such displacement may create an irregularly shaped window through the casing exit joint, which may create difficulties for drilling, completing, and producing operations in a lateral wellbore extending outwardly from the wellbore in which the casing exit joint is positioned. Casing exit joints with pre-milled windows can be used to facilitate a more geometrically controlled window profile and reduce debris. However, casing exit joints with pre-milled windows require knowing the desired orientation at installation and rotationally orienting the joint so that the window is oriented in the direction of the desired lateral wellbore. If the joint is pre-oriented, it can not be moved once it is placed downhole. However, rotating the casing exit joint is sometimes desired to improve cementing. If the joint is placed downhole and then oriented, there is a risk that the joint may get stuck, resulting in a pre-milled window in the wrong orientation.

BRIEF DESCRIPTION OF THE DRAWINGS

These drawings illustrate certain aspects of some of the embodiments of the present disclosure, and should not be used to limit or define the claims.

Figure 1:
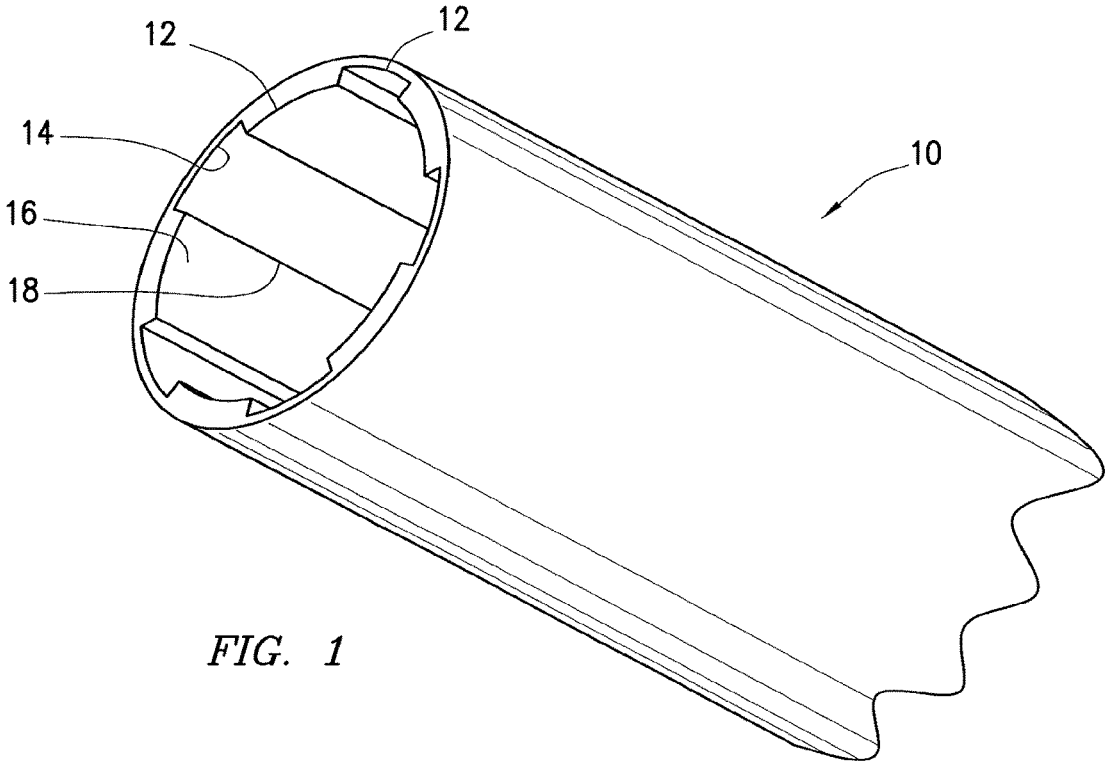
FIG. 1 is a perspective view of a casing exit joint comprising an inner guiding profile according to certain embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

As used herein, the terms "casing," "casing string," "casing joint," and similar terms refer to a substantially tubular protective lining for a wellbore. Casing can be made of any material, and can include tubulars known to those skilled in the art as casing, liner and tubing. In certain embodiments, casing may be constructed out of steel. Casing can be expanded downhole, interconnected downhole and/or formed downhole in some cases.

As used herein, the term "casing exit joint" is not meant to require that an exit joint have a length equivalent to a joint of casing. Instead, a casing exit joint can have any length suitable for interconnection as part of a casing string, and for installation in a well.

As used herein, the term "cement" is used to indicate a material which seals and secures a tubular string in a wellbore. Cement may comprise a cementitious material and/or other types of materials, such as polymers, epoxies, etc.

Directional terms, such as "above", "below", "upper", "lower", etc., are used for convenience in the present disclosure in referring to the accompanying figures. In general, "above", "upper", "upward" and similar terms refer to a direction toward the earth's surface along a wellbore, and "below", "lower", "downward" and similar terms refer to a direction away from the earth's surface along the wellbore.

The present disclosure relates to a casing exit joint and methods for use. Particularly, the present disclosure relates to a casing exit joint with guiding profiles and methods for use.

More specifically, the present disclosure relates to a casing exit joint comprising a substantially tubular casing joint comprising an inner surface and an outer surface, wherein at least a circumferential portion of the inner surface comprises a plurality of axial inner grooves. In certain embodiments, at least a circumferential portion of the outer surface comprises a plurality of axial outer grooves. In certain embodiments, the present disclosure relates to a method comprising: disposing a casing exit joint in a wellbore penetrating at least a portion of a subterranean formation, wherein the casing exit joint comprises: a substantially tubular casing joint comprising an inner surface and an outer surface, wherein at least a circumferential portion of the inner surface comprises a plurality of axial inner grooves; and cutting a window through at least a portion of the casing exit joint with a cutting tool.

Among the many potential advantages to the apparatus and methods of the present disclosure, only some of which are alluded to herein, the one or more grooves, ridges, and/or guiding profiles of the casing exit joint may guide a cutting tool as it mills through the casing exit joint, facilitating a controlled milling path and optimizing the casing exit joint window opening geometry. In certain embodiments, the guiding profiles are evenly distributed around the circumference of the casing exit joint, thereby providing several alternatives for window orientation. In certain embodiments, these alternatives provide a casing exit joint that does not require pre-orienting or orienting downhole to achieve the desired window orientation. As such, the casing exit joint provides more flexibility and versatility, such as the option to determine the desired window orientation after the casing exit joint is cemented in the wellbore, and/or the ability to select a different window orientation after cementing is complete. In certain embodiments, the casing exit joints and methods of the present disclosure may provide a casing exit joint with portions of reduced wall thickness, thereby reducing the amount of well debris created during milling. In certain embodiments, unlike pre-milled windows that often comprise "softer" materials like aluminum which are susceptible to mechanical property degradation at elevated temperatures, the casing exit joints of the present disclosure may substantially comprise steel, which is much more temperature resistant.

Embodiments of the present disclosure and their advantages are best understood by references to FIGS. 1 through 9, where like numbers are used to indicate like and corresponding features.

Representatively illustrated in FIG. 1 is a perspective view of a casing exit joint according to certain embodiments of the present disclosure. The casing exit joint 10 may comprise a substantially tubular casing joint 10. In certain embodiments, the inner surface 12 of casing exit joint 10 has an optimized wall thickness geometry comprising a plurality of inner grooves 14 oriented axially along the casing exit joint 10. As used herein, "grooves" refer to circumferentially disposed sections of a surface of the casing exit joint 10 having less wall thickness than at least one other section of the casing exit joint 10. In certain embodiments, a groove may comprise a notch, channel, or other recess. As used herein, "wall thickness" means the difference between the outer diameter and the inner diameter of the casing exit joint 10. One of skill in the art would appreciate that the inner grooves 14 could be a notch, channel, or other recess that has a reduced wall thickness compared to another part of the casing exit joint 10.

In certain embodiments, the inner surface 12 of the casing exit joint 10 comprises at least four axial inner grooves 14. In some embodiments, the inner grooves 14 are circumferentially distributed around the inner surface 12. In certain embodiments, the inner grooves 14 are evenly distributed around the circumference of the inner surface 12. In certain embodiments, the axial inner grooves 14 may extend along the entire length of the casing exit joint 10. In some embodiments, the axial inner grooves 14 may extend along at least about 50%, at least about 40%, at least about 30%, at least about 20%, or at least about 10% of the casing exit joint 10.

In some embodiments, at least a portion of the inner axial grooves 14 may comprise a filler material (not shown). As used herein, "filler material" refers to any material that is less resistant to milling than the material of the casing exit joint 10. In certain embodiments, the filler material may form a more uniform inner surface 12, which may, for example, reduce debris accumulation in the inner grooves 14, facilitate passage of downhole devices (for example, wipers or plugs), and/or avoid fluid bypass issues. In certain embodiments, the filler material may include, but is not limited to polytetrafluoroethylene, a polymer, a composite, or any combination thereof. In some embodiments, the filler material may comprise any other suitable material.

Figure 2:
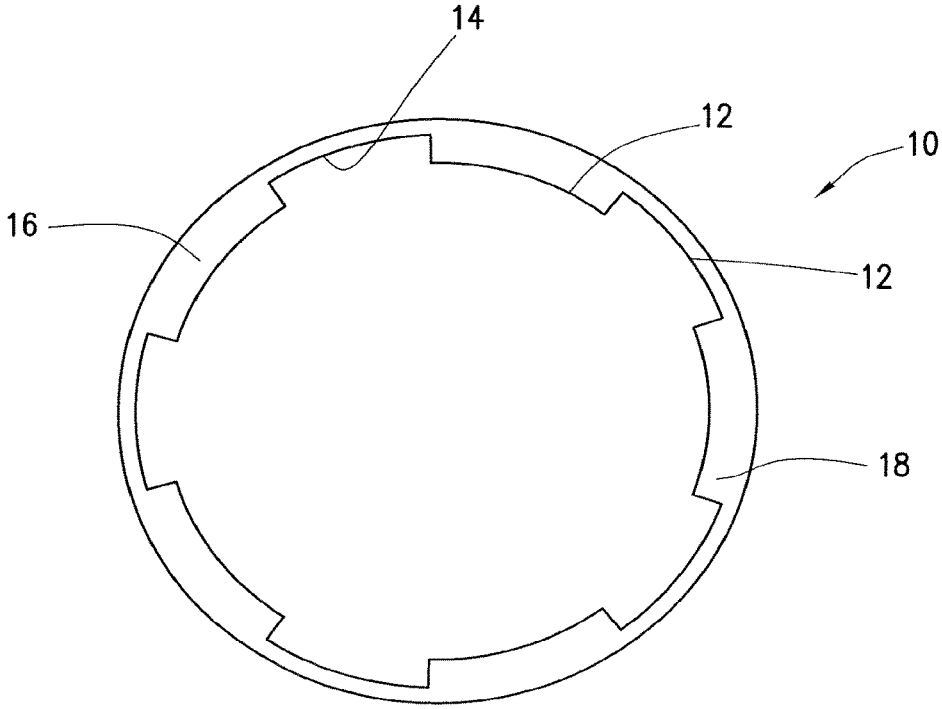
FIG. 2 is an axial cross section of a casing exit joint comprising an inner guiding profile according to certain embodiments of the present disclosure.

The portions of the casing exit joint 10 between the inner grooves 14 may form inner ridges 16. The inner ridges 16 may be sections of the inner surface 12 between the inner grooves 14 having greater wall thickness than the inner grooves 14. The inner ridges 14 may also be axially oriented and circumferentially disposed around the inner surface 12 of the casing exit joint 10. Together, the inner ridges 16 and inner grooves 14 may form an inner guiding profile 18. In certain embodiments, the inner guiding profile 18 extends along the entire length of the inner surface 12. In some embodiments, the inner guiding profile 19 extends along only about the upper 50% (for example, the half closest to the surface) or less of the inner surface 12 of the casing exit joint 10. In some embodiments, the inner guiding profile 18 may extend along at least about 50%, at least about 40%, at least about 30%, at least about 20%, or at least about 10% of the casing exit joint 10. FIG. 2 depicts a cross-sectional view of a portion of a casing exit joint 10 comprising an inner guiding profile 18 with five inner grooves 14. In some embodiments, the inner grooves 14 are evenly circumferentially distributed around the inner surface 12 of the casing exit joint 10.

Each inner groove 14 may represent a potential orientation for cutting a window through which a branch wellbore could be created. As such, the inner guiding profile 18 may provide several orientations for cutting a window, and thereby several orientations for drilling a lateral wellbore. For example, in embodiments where the inner surface 12 of the casing exit joint 10 comprises five axial inner grooves 12, there may be at least five potential window orientations.

In some embodiments, having multiple potential window orientations provides sufficient versatility such that the casing exit joint 10 does not need to be oriented before being introduced into a wellbore.

Figure 3:
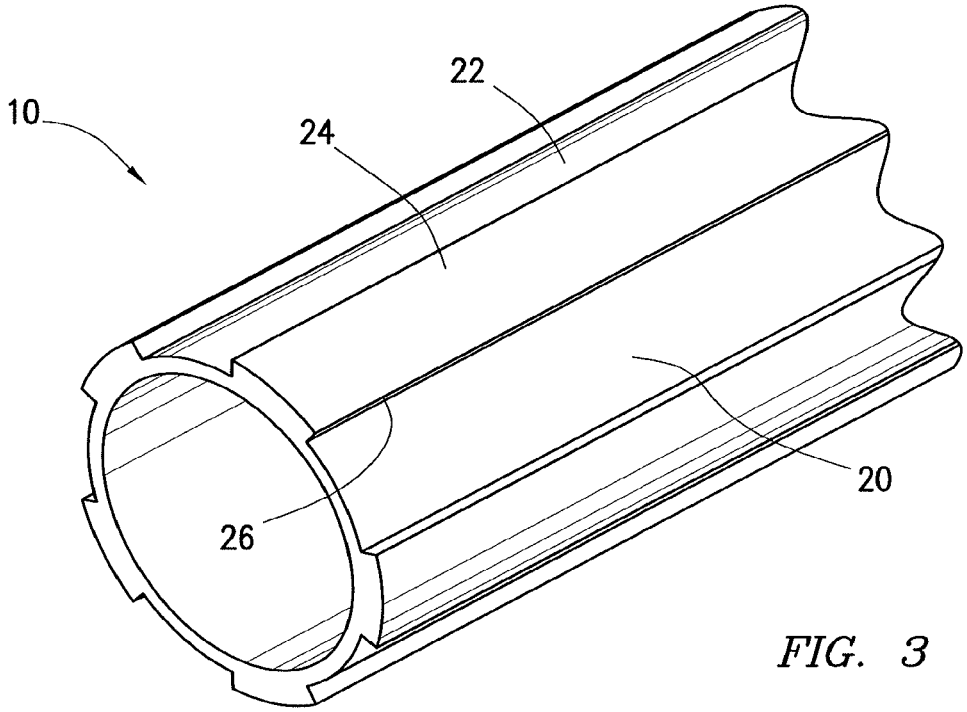
FIG. 3 is a perspective view of a casing exit joint comprising an outer guiding profile according to certain embodiments of the present disclosure.

Referring additionally now to FIG. 3, the outer surface 20 of the casing exit joint 10 may also comprise axial outer grooves 22 and axial outer ridges 24. Similar to the inner grooves 14 (see FIG. 1), the outer grooves 22 may have a reduced wall thickness compared to other portions of the casing exit joint 10. One of skill in the art would appreciate that the outer grooves 22 could be a notch, channel, or other recess that has a reduced wall thickness compared to another portion of the casing exit joint 10.

In certain embodiments, the outer surface 20 of the casing exit joint 10 comprises a plurality of axial outer grooves 22. In some embodiments, the outer surface 20 of the casing exit joint 10 comprises at least four axial outer grooves 22. In certain embodiments, the axial outer grooves 22 are circumferentially distributed around the outer surface 20 of the casing exit joint 10. In certain embodiments, the outer grooves 22 are evenly distributed around the circumference of the outer surface 20 of the casing exit joint 10. In certain embodiments, the axial outer grooves 22 may extend along the entire length of the casing exit joint 10. In some embodiments, the axial outer grooves 22 may extend along at least about 50%, at least about 40%, at least about 30%, at least about 20%, or at least about 10% of the casing exit joint 10.

In some embodiments, at least a portion of the outer axial grooves 22 may comprise a filler material (not shown). In certain embodiments, the filler material may form a more uniform outer surface 20, which may, for example, reduce debris accumulation and/or avoid fluid bypass issues. In certain embodiments, the filler material may include, but is not limited to polytetrafluoroethylene, a polymer, a composite, any other suitable material, or any combination thereof.

Figure 4:
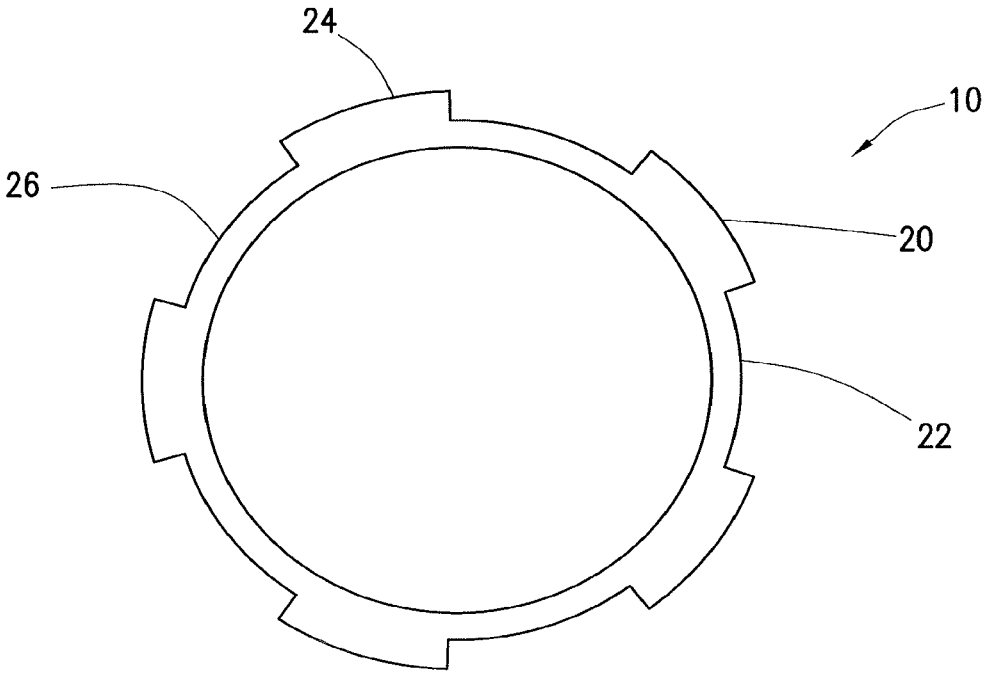
FIG. 4 is an axial cross section of a casing exit joint comprising an outer guiding profile according to certain embodiments of the present disclosure.

The outer ridges 24 may be sections of the outer surface 20 between the outer grooves 22 having greater wall thickness than the outer grooves 22. Generally, there may be two or more outer grooves 22 in the outer surface 20 of the casing exit joint 10. In some embodiments, the outer surface 20 comprises four or more outer grooves 22. Together, the outer ridges 24 and outer grooves 22 form an outer guiding profile 26. In certain embodiments, the outer guiding profile 26 runs the entire length of the casing exit joint 10. In some embodiments, the outer guiding profile 26 extends along about the lower 50% (for example, the half farthest from the surface) or less of the outer surface 20 of the casing exit joint 10. FIG. 4 depicts a cross-sectional view of a portion of a casing exit joint 10 comprising an outer guiding profile 26 with five outer grooves 22. In some embodiments, the outer guiding profile 26 may extend along at least about 50%, at least about 40%, at least about 30%, at least about 20%, or at least about 10% of the casing exit joint 10. In some embodiments, the outer grooves 22 are evenly circumferentially distributed around the outer surface 20 of the casing exit joint 10.

Figure 5:
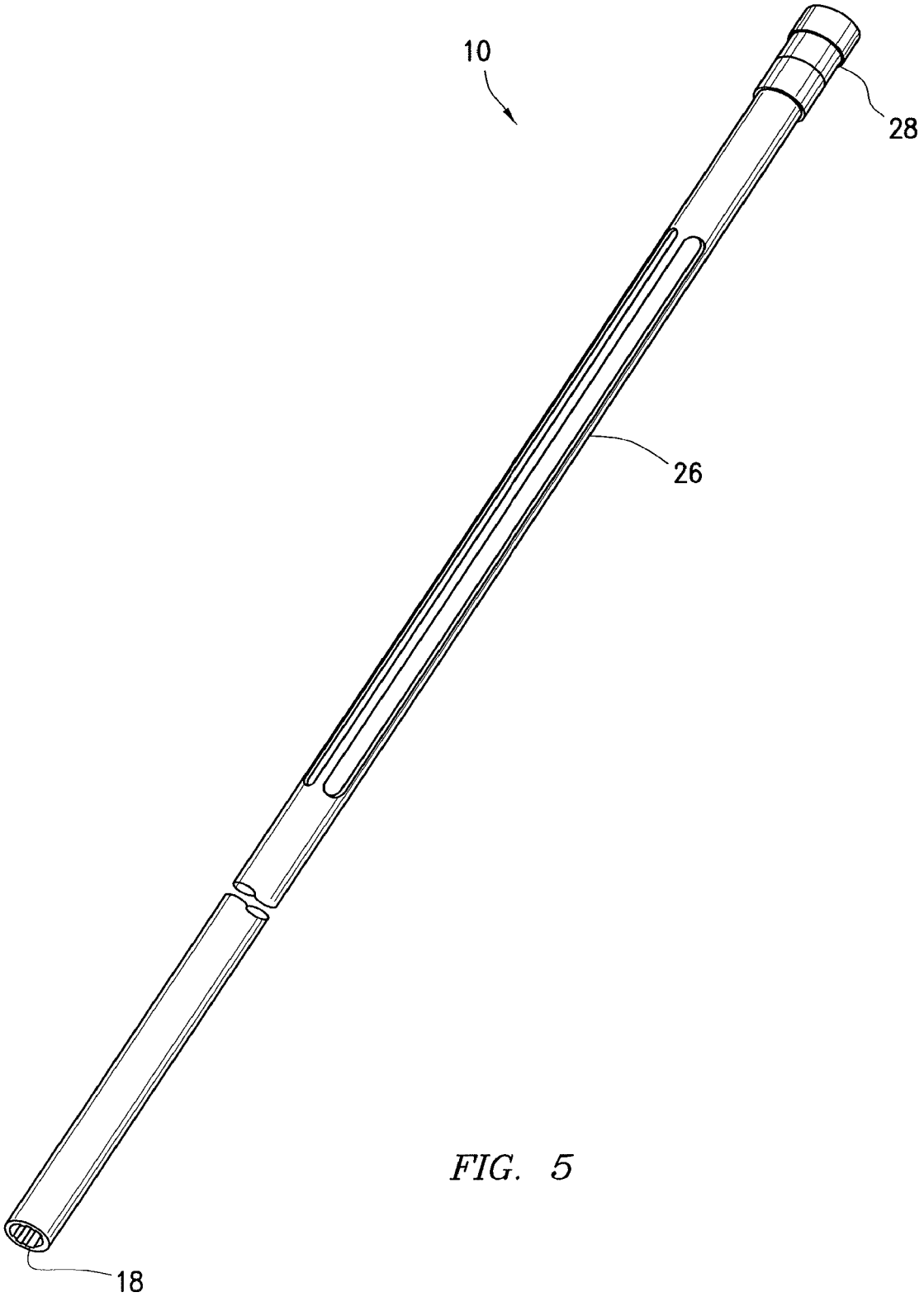
FIG. 5 is a perspective view of a casing joint comprising an inner guiding profile and an outer guiding profile according to certain embodiments of the present disclosure.

Referring additionally now to FIG. 5, a casing exit joint 10 may comprise an inner guiding profile 18, outer guiding profile 26, or both. In some embodiments, both the inner guiding profile 18 and outer guiding profile 26 extend along the entire length of the casing exit joint 10. In certain embodiments, approximately the upper half of the casing exit joint 10 comprises an inner guiding profile 18, and approximately the lower half of the casing exit joint 10 comprises an outer guiding profile 26. One of skill in the art would appreciate that other configurations of inner guiding profiles 18 and outer guiding profiles 26 may be suitable for some embodiments of the present disclosure. In some embodiments, the casing exit joint 10 may be secured by engagement with a locating profile 28. The locating profile 28 may be configured to receive a corresponding latch mechanism (not shown) of the casing exit joint 10. For example, the locating profile may comprise a latch coupling. The locating profile 28 may include various tools and tubular lengths interconnected in order to rotate and align the casing exit joint 10. In some embodiments, the locating profile 28 may be a Sperry multilateral latch or coupling system available from Halliburton Energy Services of Houston, Tex., USA.

Figure 6:
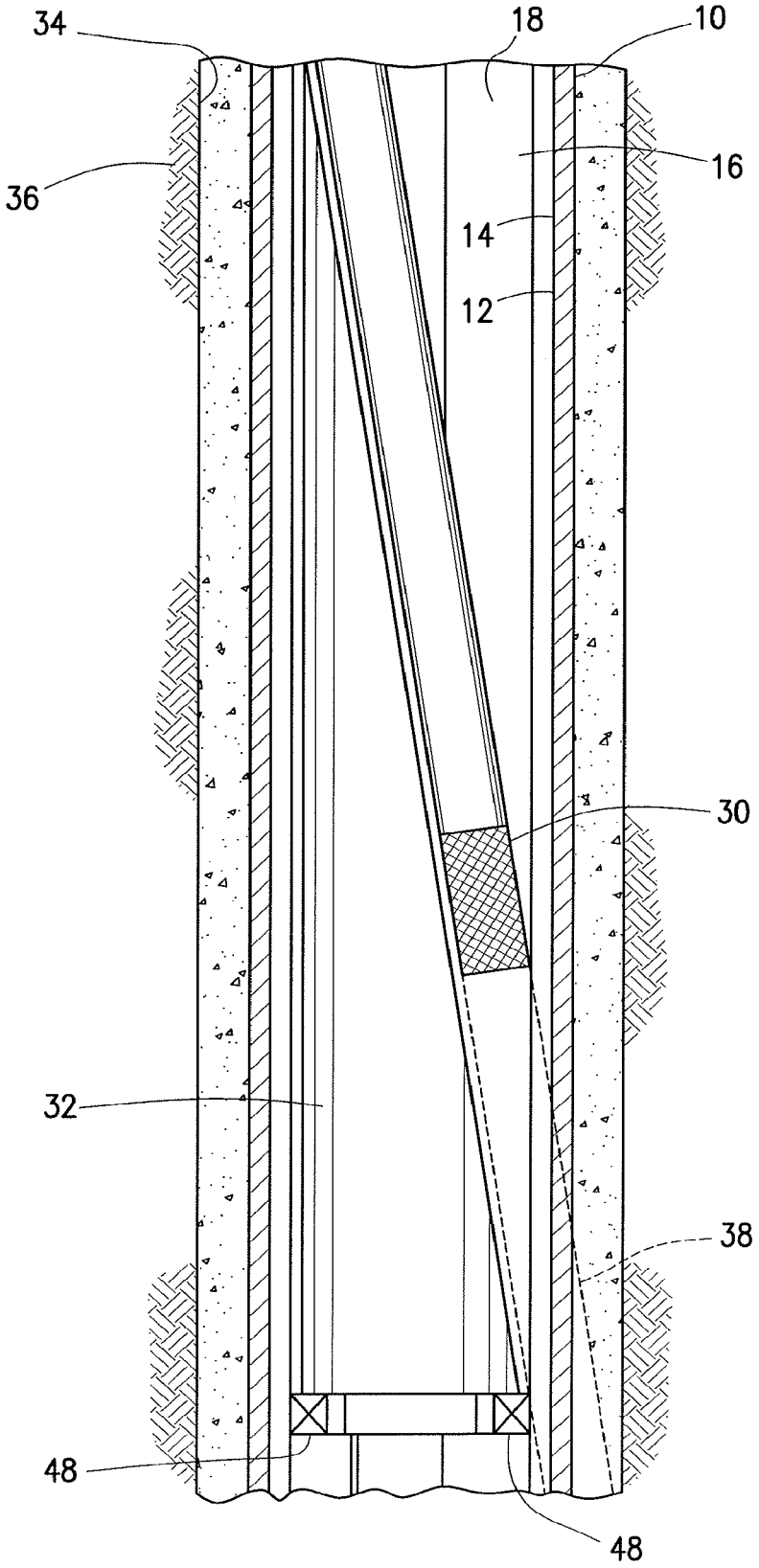
FIG. 6 is a diagram illustrating a cutting tool deployed in a casing exit joint according to certain embodiments of the present disclosure.

FIG. 6 is a diagram illustrating a cross-section of a casing exit joint 10 according to certain embodiments of the present disclosure. The casing exit joint 10 is disposed in a wellbore 34 penetrating at least a portion of a subterranean formation 36. In certain embodiments, the casing exit joint 10 is part of a casing string (not shown). In some embodiments, the casing exit joint 10 is cemented at a portion of the wellbore 34. In some embodiments, a measurement-while-drilling (MWD) or logging-while-drilling (LWD) tool may be run while installing the casing exit joint 10 such that the installed orientations of the guiding profiles 18, 26 are known. In certain embodiments, a logging run may be performed after installing the casing to determine the orientation of the guiding profiles 18, 26. A deflection device 32, such as a whipstock, may be installed in the casing exit joint 10. In certain embodiments, the deflection device 32 may be held in place by one or more anchors 48. In some embodiments, the deflection device 32 may be offset such that when installed it is aligned to achieve an optimal milling orientation. In some embodiments, this may be performed via a locating profile 28 (see FIG. 5) pre-oriented to one of the guiding profiles 18, 26 in which the deflection device 32 is aligned via latch keys. A cutting tool 30, such as a mill or drill, is run downhole. The cutting tool 30 mills through the inner surface 12 and the outer surface 20 of the casing exit joint 10 to form a window through which a branch wellbore 38 can be created in the subterranean formation 36. The inner guiding profile 18 may help prevent lateral displacement (or "roll-off") of the cutting tool 30 as it begins to cut through the inner surface 12 of the casing exit joint 10. The deflection device 32 may deflect the cutting tool 30 towards the inner surface 12 of the casing exit joint 10. The cutting tool 30 may engage with at least a portion of the inner guiding profile 18 (for example, the inner grooves and inner ridges).

The inner guiding profile 18 may facilitate a controlled milling path, and reduce potential lateral displacement commonly associated with casing exit milling. For example, the grooves of the inner guiding profile 18 may present less resistance to the cutting tool 30 than the ridges, and, because cutting tools 30 generally take the path of least resistance, the cutting tool 30 may tend to stay within one or more grooves. This may reduce the tendency of the cutting tool 30 to "walk" laterally in the direction of rotation of the cutting tool 30. In certain embodiments, a casing exit joint 10 comprising an inner guiding profile 18, outer guiding profile 26, or both, generates less debris during milling than a casing exit joint 10 without such guiding profiles.

Figure 7:
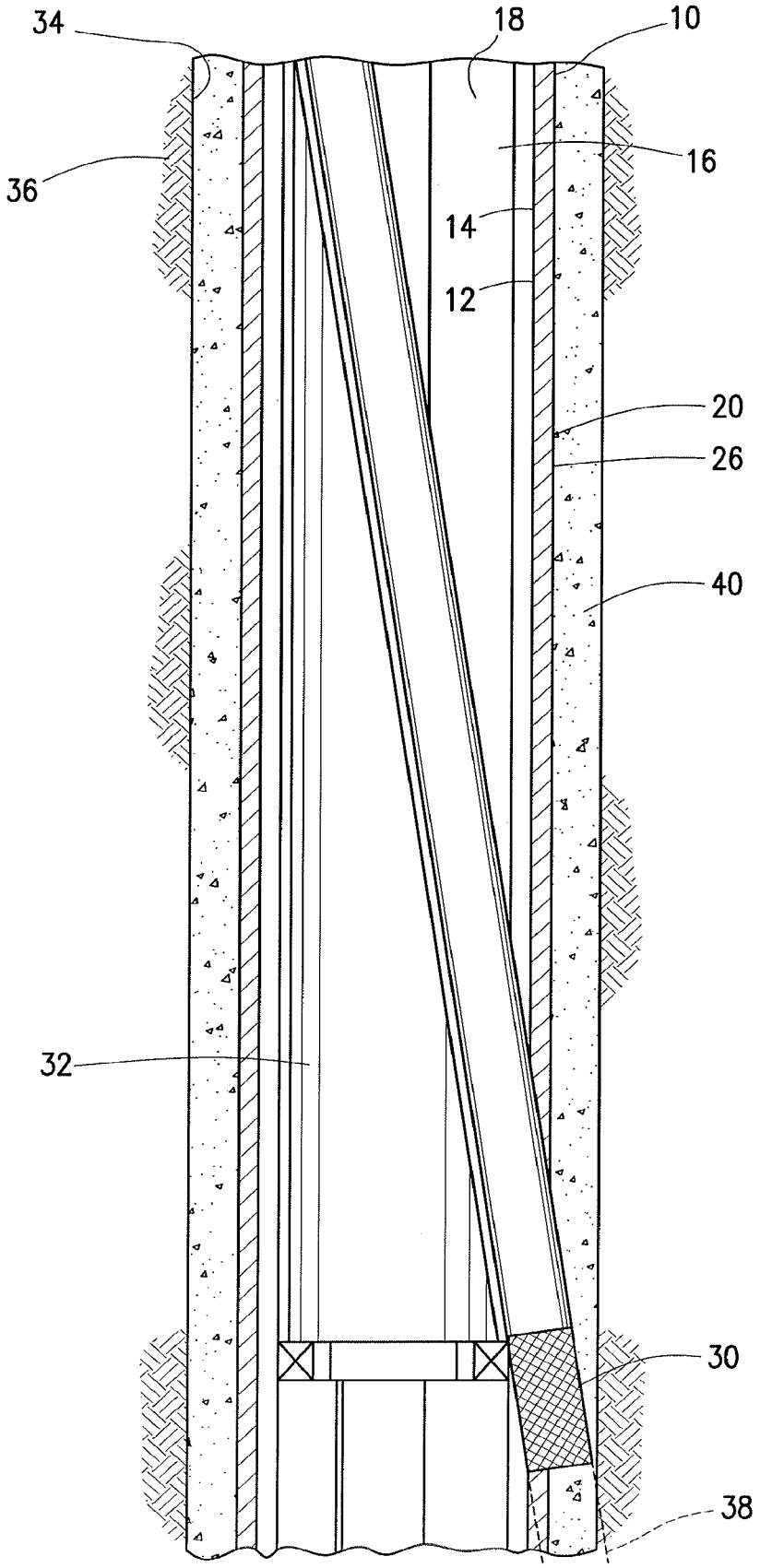
FIG. 7 is a diagram illustrating a cutting tool that has partially milled through a casing exit joint according to certain embodiments of the present disclosure.

Referring additionally now to FIG. 7, once the cutting tool 30 has milled through the inner surface 12 and outer surface 20 of the casing exit joint 10, the cutting tool 30 may engage with the outer guiding profile 26. The outer guiding profile 26 may help prevent lateral displacement of the cutting tool 30 as it mills through the outer surface of the casing exit joint 10 and into the cement 40 and subterranean formation 36. In some embodiments, for example, a cutting tool 30 that has milled halfway through the casing exit joint 10 may engage both the inner guiding profile 18 and the outer guiding profile 26.

Figure 8:
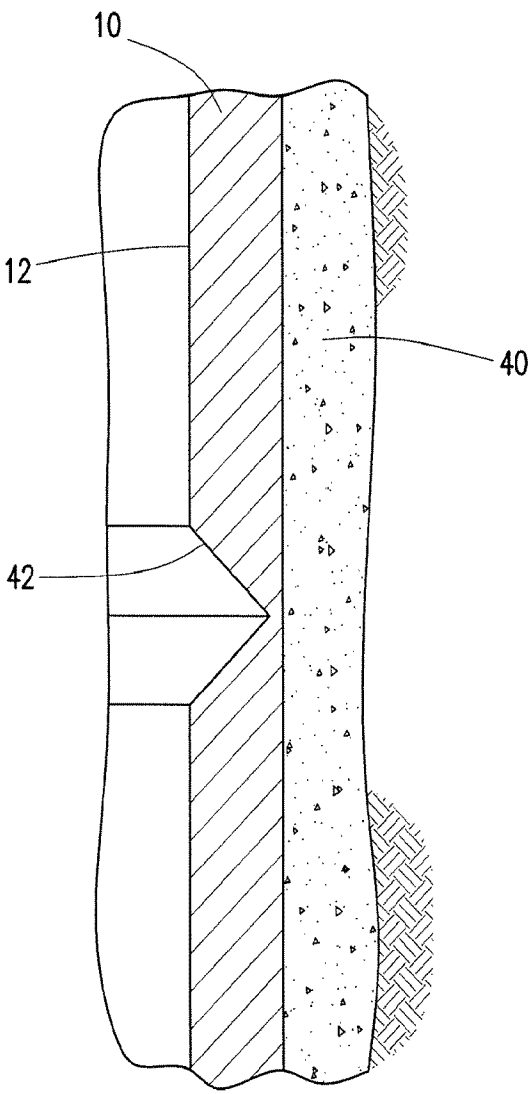
FIG. 8 is a diagram illustrating a cross-sectional view of a casing exit joint comprising a internal profile according to certain embodiments of the present disclosure.

Referring additionally now to FIG. 8, the inner surface 12 of the casing exit joint 10 may comprise an internal profile 42. In certain embodiments, the internal profile 42 may comprise a circumferentially extending notch or inclined shoulder. The internal profile 42 may improve cut initiation by providing a profile (for example, an edge) on which the cutting tool 30 may initiate the casing exit. The internal profile 42 may be formed where the cutting tool 30 will first contact the inner surface 12 of the casing exit joint 10 in the milling operation to cut a window through the casing exit joint 10. In some embodiments, however, the internal profile 42 may be formed at other suitable positions on the casing exit joint 10.

Figure 9:
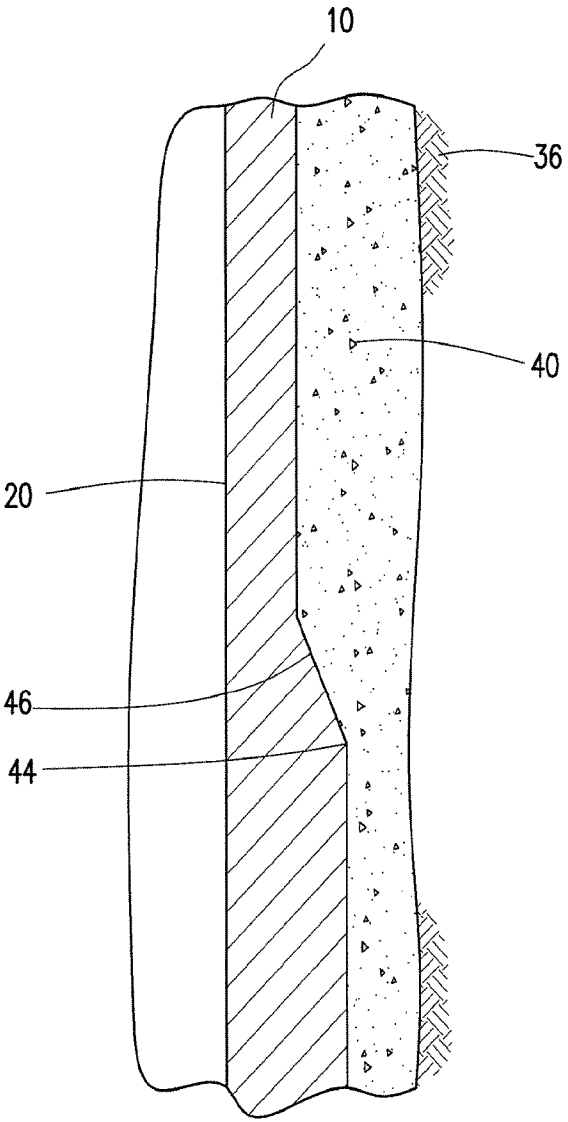
FIG. 9 is a diagram illustrating a cross-sectional view of a casing exit joint comprising a kick-off pad according to certain embodiments of the present disclosure.

FIG. 9 is a diagram illustrating a potential modification to a casing exit joint 10 according to certain embodiments of the present disclosure. In certain embodiments, a circumferential portion of the outer surface 20 of the casing exit joint 10 may comprise a kick-off pad 44. In certain embodiments, the kick-off pad 44 may comprise a section of outer surface 20 with increased wall thickness. In some embodiments, the kick-off pad 44 may comprise an inclined shoulder 46 that increases in wall thickness toward the lower portion of the casing exit joint 10. In certain embodiments, the kick-off pad 44 may be positioned at the base of a casing exit joint 10. In some embodiments, the kick-off pad 44 may aid in guiding a cutting tool 30 away from the casing exit joint 10 and into the subterranean formation 36. In certain embodiments, the kick-off pad 44 may reduce the tendency of the cutting tool 30 to track down the outer surface 20 of the casing exit joint 10. In some embodiments, the kick-off pad 44 may be formed at a position where the cutting tool 30 is intended to displace away from the casing exit joint 10 and into the cement 40 and subterranean formation 36. In certain embodiments, the kick-off pad 44 may be configured to facilitate the departure of the cutting tool 30 from the casing exit joint 10.

According to aspects of the present disclosure, an example casing exit joint may comprise a substantially tubular casing joint comprising an inner surface and an outer surface, wherein at least a circumferential portion of the inner surface comprises a plurality of axial inner grooves. The plurality of axial inner grooves may have a wall thickness less than the wall thickness of at least one other portion of the casing exit joint. In certain embodiments, the plurality of axial inner grooves extend along at least about 50% of the casing exit joint. At least a portion of each of the plurality of axial inner grooves may comprise a filler material. In certain embodiments, the plurality of axial inner grooves comprises at least four axial inner grooves. In some embodiments, the inner surface further comprises a circumferential internal profile configured to facilitate a milling operation.

In certain embodiments, at least a circumferential portion of the outer surface comprises a plurality of axial outer grooves. The plurality of axial outer grooves may have a wall thickness less than the wall thickness of at least one other portion of the casing exit joint. In certain embodiments, the plurality of axial outer grooves extend along at least about 50% of the casing exit joint. At least a portion of each of the plurality of axial outer grooves may comprise a filler material. In certain embodiments, the plurality of axial outer grooves comprise at least four axial outer grooves. In some embodiments, the outer surface further comprises a kick-off pad.

According to aspects of the present disclosure, an example method comprises: disposing a casing exit joint in a wellbore penetrating at least a portion of a subterranean formation, wherein the casing exit joint comprises: a substantially tubular casing joint having an inner surface and an outer surface, wherein at least a circumferential portion of the inner surface comprises a plurality of axial inner grooves; and cutting a window through at least a portion of the casing exit joint with a cutting tool. In certain embodiments, at least a circumferential portion of the outer surface comprises a plurality of axial outer grooves. In certain embodiments, the cutting tool engages with at least one of the plurality of axial inner grooves. The cutting tool may resist lateral displacement due, at least in part, to the engagement with at least one of the plurality of axial inner grooves. In certain embodiments, disposing does not include orienting the casing exit joint. In some embodiments, the cutting tool engages with at least one of the plurality of axial outer grooves.

According to aspects of the present disclosure, an example casing exit joint may comprise a substantially tubular casing joint having an inner surface comprising an inner guiding profile to reduce lateral displacement of a cutting tool milling through the casing exit joint; and an outer surface. In certain embodiments, the outer surface comprises an outer guiding profile to reduce lateral displacement of the cutting tool milling through the casing exit joint.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A casing exit joint comprising:

a substantially tubular casing joint comprising an inner surface and an outer surface, wherein the inner surface comprises a plurality of axial inner grooves evenly circumferentially distributed around the inner surface about a central longitudinal axis of the tubular casing joint, each axial inner groove extending farther in an axial direction than in a circumferential direction and wherein the plurality of axial inner grooves reduce lateral displacement of a cutting tool that contacts one or more of the plurality of axial inner grooves as the cutting tool mills through the inner surface of the casing exit joint.

2. The casing exit joint of claim 1, wherein the plurality of axial inner grooves have a wall thickness less than the wall thickness of at least one other portion of the casing exit joint.

3. The casing exit joint of claim 1, wherein the plurality of axial inner grooves extend along at least 50% of the casing exit joint.

4. The casing exit joint of claim 1, wherein at least a portion of each of the plurality of axial inner grooves comprises a filler material.

5. The casing exit joint of claim 1, wherein the plurality of axial inner grooves comprises at least four axial inner grooves.

6. The casing exit joint of claim 1, wherein the inner surface further comprises a circumferential internal profile to facilitate a milling operation.

7. The casing exit joint of claim 1, wherein the outer surface comprises a kick-off pad.

8. The casing exit joint of claim 1, wherein at least a circumferential portion of the outer surface comprises a plurality of axial outer grooves.

9. The casing exit joint of claim 8, wherein the plurality of axial outer grooves have a wall thickness less than a wall thickness of at least one other portion of the casing exit joint.

10. The casing exit joint of claim 8, wherein the plurality of axial outer grooves extend along at least 50% of the casing exit joint.

11. The casing exit joint of claim 8, wherein at least a portion of each of the plurality of axial outer grooves comprises a filler material.

12. The casing exit joint of claim 8, wherein the plurality of axial outer grooves comprises at least four axial outer grooves.

13. A method comprising:

disposing a casing exit joint in a wellbore penetrating at least a portion of a subterranean formation, wherein the casing exit joint comprises: a substantially tubular casing joint comprising an inner surface and an outer surface, wherein the inner surface comprises a plurality of axial inner grooves evenly circumferentially distributed around the inner surface about a central longitudinal axis of the tubular casing joint, each axial inner groove extending farther in an axial direction than in a circumferential direction; and cutting a window through at least a portion of the circumferential portion of the inner surface that comprises the plurality of axial inner grooves with a cutting tool.

14. The method of claim 13, wherein at least a circumferential portion of the outer surface comprises a plurality of axial outer grooves.

15. The method of claim 13, wherein the cutting tool engages with at least one of the plurality of axial inner grooves.

16. The method of claim 15, wherein the cutting tool resists lateral displacement due, at least in part, to the engagement with at least one of the plurality of axial inner grooves.

17. The method of claim 14, wherein the cutting tool engages with at least one of the plurality of axial outer grooves.

18. A casing exit joint comprising: a substantially tubular casing joint having an inner surface comprising an inner guiding profile, wherein the inner guiding profile comprises a plurality of inner axial grooves evenly circumferentially distributed around the inner surface about a central longitudinal axis of the tubular casing joint, each axial inner groove extending along at least 10% of an axial length of the casing exit joint and wherein the plurality of axial inner grooves reduce lateral displacement of a cutting tool that contacts one or more of the plurality of axial inner grooves as the cutting tool mills through the inner surface of the casing exit joint; and an outer surface.

19. The casing exit joint of claim 18, wherein the outer surface comprises an outer guiding profile to reduce lateral displacement of the cutting tool milling through the casing exit joint.

* * * * *